US012669305B2

(12) United States Patent
Andrew et al.

(10) Patent No.: US 12,669,305 B2
(45) Date of Patent: Jun. 30, 2026

(54) MOBILE GUN SYSTEM

(71) Applicant: BAE SYSTEMS PLC, London (GB)

(72) Inventors: Griffith Peter Andrew, Barrow-in-Furness (GB); Richard Peter Lewin, Barrow-in-Furness (GB); Matthew Kirk, Barrow-in-Furness (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/997,126

(22) PCT Filed: Jul. 7, 2023

(86) PCT No.: PCT/GB2023/051795
§ 371 (c)(1),
(2) Date: Jan. 20, 2025

(87) PCT Pub. No.: WO2024/018179
PCT Pub. Date: Jan. 25, 2024

(65) Prior Publication Data

US 2025/0377182 A1 Dec. 11, 2025

(30) Foreign Application Priority Data

Jul. 20, 2022 (EP) ..... 22275100
Jul. 20, 2022 (GB) ..... 2210615

(51) Int. Cl.
*F41A 25/02* (2006.01)

(52) U.S. Cl.
CPC ..... *F41A 25/02* (2013.01)

(58) Field of Classification Search
CPC ..... F41A 25/02; F41A 25/04
(Continued)

(56) References Cited

U.S. PATENT DOCUMENTS 5,210,370 A * 5/1993 Mraz ..... F41A 25/00 89/37.14
6,702,050 B1 3/2004 Mazhar
(Continued)

FOREIGN PATENT DOCUMENTS

FR 504252 A 6/1920
GB 158023 A 2/1921
(Continued)

OTHER PUBLICATIONS

GB Search Report under Section 17(5) received for GB Application No. 2210615.7, dated Nov. 25, 2022. 3 pages.
(Continued)

*Primary Examiner* — Bret Hayes
(74) *Attorney, Agent, or Firm* — Arcane Law PLLC

(57) ABSTRACT

The present disclosure relates to a mobile gun system. The mobile gun system comprises a chassis and a gun barrel mounted to the chassis such that when a projectile is fired from the gun barrel a recoil force causes recoil movement of the chassis. The mobile gun system further comprises a braking system for retarding the recoil movement of the chassis due to the recoil force from the firing of the projectile from the gun barrel. The mobile gun system further comprises a controller configured to control the braking system to retard said recoil movement of the chassis after a peak loading condition due to the firing of the projectile has passed. The present disclosure also relates to a method of operating a mobile gun system.

18 Claims, 6 Drawing Sheets

(58) Field of Classification Search
USPC ..... 89/14.3, 40.01, 42.01
See application file for complete search history.

(56) References Cited

U.S. PATENT DOCUMENTS

| | | | | |
|---|---|---|---|---|
| 9,481,414 | B1 * | 11/2016 | Thielman | G05D 1/0011 |
| 2008/0053301 | A1 * | 3/2008 | Balbo | F41A 23/32 89/40.01 |
| 2015/0174979 | A1 | 6/2015 | Raczek et al. | |
| 2024/0410670 | A1 * | 12/2024 | Elliott | F41A 25/16 |

FOREIGN PATENT DOCUMENTS

| | | | |
|---|---|---|---|
| RU | 2607495 | C2 | 1/2017 |
| WO | WO2024018179 | A1 | 1/2024 |

OTHER PUBLICATIONS

International Search Report and Written Opinion Received for PCT/GB 2023/051795, dated Nov. 23, 2023. 19 pages.
Extended European Search Report received for EP Application No. 22275100.0, dated Dec. 23, 2022. 14 pages.

* cited by examiner

MOBILE GUN SYSTEM

FIELD

The present invention relates to a mobile gun system and to a method of operating a mobile gun system.

BACKGROUND

When gun systems such as artillery fire, the gun generates very large recoil forces which must be managed and dissipated. Failing to dissipate the recoil forces leads to large loads being placed on the system that can reduce the service life of the system. In addition, when firing at low angles the recoil loads may generate an overturning moment which may cause the weapon to jump or even overturn during the shot. To mitigate this, lightweight systems may be anchored to the ground e.g. via spades. However, these spades add weight to the system.

In such systems the recoil forces may be managed by increasing the recoiling mass as, via conservation of momentum, the recoil velocity is reduced. However, this adds weight to the gun system, meaning that it is difficult to create a stable light weight system wherein the recoil is adequately mitigated.

A gun system that is relatively lightweight and yet stable when absorbing recoil forces is highly desirable.

SUMMARY

According to an aspect of the present invention, there is provided a mobile gun system comprising: a chassis; a gun barrel mounted to the chassis such that when a projectile is fired from the gun barrel a recoil force causes recoil movement of the chassis; a braking system for retarding the recoil movement of the chassis due to the recoil force from the firing of the projectile from the gun barrel; and, a controller configured to control the braking system to retard said recoil movement of the chassis after a peak loading condition due to the firing of the projectile has passed.

In some embodiments, the mobile gun system comprises a body that includes the chassis, and wherein the peak loading condition occurs when a peak load is exerted on the body of the mobile gun system due to the firing of the projectile from the gun barrel. In some embodiments, the peak loading condition occurs when a peak load is exerted on the chassis due to the firing of the projectile from the gun barrel.

In some embodiments, the peak load on the body (for example, on the chassis) is detected using a force sensor. Alternatively, or additionally, the peak load on the body (for example, on the chassis) having passed may be determined indirectly, for example, by determining one or more of: when a predetermined time period after firing the projectile has passed; when the projectile has exited the barrel (including determining a predetermined time after the projectile has exited the barrel); or by monitoring one or more parameters of a primary recoil mitigation system (e.g. a parameter of a damper of the primary recoil mitigation system, such as a pressure of a fluid in the damper).

In some embodiments, the gun barrel is mounted to the chassis such that when a projectile is fired from the gun barrel the recoil force causes the gun barrel to move relative to the chassis, the mobile gun system further comprising a recoil mitigation system configured to exert a recoil mitigation force on the gun barrel to retard said movement of the gun barrel relative to the chassis.

In some embodiments, the peak loading condition is when the recoil mitigation force exerted on the gun barrel by the recoil mitigation system in response to the firing of the projectile reaches a peak value.

In some embodiments, the mobile gun system further comprises a sensor connected to the controller, wherein the controller is configured to determine whether the peak loading condition has passed based on information detected by the sensor.

In some embodiments, the sensor is configured to detect information indicative of the recoil mitigation force.

In some embodiments, the recoil mitigation system comprises a fluid configured such that the pressure of the fluid increases when the gun barrel moves relative to the chassis due to the recoil force, and wherein the sensor is configured to detect information indicative of a parameter of the fluid and, preferably, wherein said parameter is the pressure of the fluid.

In some embodiments, the sensor is configured to detect the motion of the gun barrel.

In some embodiments, the sensor is configured to detect the velocity and/or acceleration of the gun barrel, for example, relative to the chassis.

In some embodiments, the controller is configured to control the braking system to retard said recoil movement of the chassis a predetermined time period after the firing of the projectile. In some embodiments, the predetermined time period is calculated from the time a signal is sent to fire the projectile.

In some embodiments, the controller is configured to control the braking system to retard said recoil movement of the chassis after the projectile has exited the barrel. In some embodiments, the projectile leaving the barrel is determined using a sensor. For example, the sensor may be a muzzle radar. The muzzle radar may be configured to determine that the projectile has exited the barrel. In another embodiment, the projectile exiting the barrel may be determined based on the barrel movement.

In some embodiments, the controller is configured to control the braking system to retard said recoil movement of the chassis a predetermined time period after the projectile has exited the barrel. For example, once the controller receives a signal from a sensor (e.g. a muzzle radar) that determines the projectile has exited the barrel, the controller then waits a predetermined time period before operating the braking system, the predetermined time being chosen such that after the predetermined time, the peak loading condition has passed.

In some embodiments, the mobile gun system is not capable of firing broadside. In some embodiments, the range of motion of the gun barrel relative to the chassis may be limited such that the gun barrel is not capable of being rotated relative to the chassis to a position to fire broadside.

In some embodiments, the gun barrel is constrained to be rotatable by no more than +/−5 degrees about an axis substantially perpendicular to the ground.

In some embodiment, the chassis extends along an x-axis. A first end of the chassis and a second end of the chassis may be spaced apart from one another along the length of the chassis along the x-axis.

In some embodiments, the chassis also extends along a y-axis along the width of the chassis. The x-axis may be at right angles to the y-axis. A first side of the chassis and a second side of the chassis may be spaced apart from one another across the width of the chassis along the y-axis.

In some embodiments, the chassis further comprises a z-axis that is at right angles to the x-axis and y-axis. The z-axis may extend substantially normal to the ground.

In some embodiments, the gun barrel is constrained to be rotatable by no more than +/−5 degrees about the z-axis or about an axis parallel to the z-axis.

In some embodiments, the gun barrel is constrained to be rotatable by no more than +/−5 degrees relative to a direction parallel to the x-axis around the z-axis.

In some embodiments, the braking system comprises an anti-lock braking system (ABS).

In some embodiments, the mobile gun system comprises a plurality of wheels and/or tracks, and wherein the braking system is configured to brake at least one of the wheels and/or tracks to retard said recoil movement of the chassis.

In some embodiments, the controller is configured to adjust the amount of braking applied to one or more of the wheels and/or tracks to adjust the direction of recoil movement of the chassis due to the recoil force.

In some embodiments, the mobile gun system comprises an orientation sensor configured to detect information indicative of the orientation of the chassis, wherein the controller is configured to adjust the direction of recoil movement of the chassis based on the information detected by the orientation sensor.

In some embodiments, the braking system is configured to apply a reduced braking force prior to the peak loading condition, and wherein the braking system applies a larger braking force after the peak loading condition.

In some embodiments, the reduced braking force is no longer applied once the projectile has left the gun barrel. In some embodiments, the reduced braking force is a constant braking force.

In some embodiments, the unladen mass of the mobile gun system is no greater than 10 tonnes and, preferably, is no greater than 5 tonnes.

In some embodiments, the mobile gun system is an artillery gun system.

In some embodiments, the mobile gun system is a howitzer, for example, a self-propelled howitzer.

In some embodiments, the mobile gun system is a deployable mobile gun system and, optionally, may be a helicopter deployable mobile gun system.

In some embodiments, the mobile gun system is self-propelled.

In some embodiments, the mobile gun system is a field gun.

In some embodiments, the mobile gun system does not comprise any anchors and/or spades that are deployed to anchor the mobile gun system relative to the ground prior to firing the projectile.

In some embodiments, the recoil movement of the chassis (e.g. movement of the chassis from the projectile being fired until the chassis is rendered stationary by the braking system) is at least 0.5 metres.

In some embodiments, the recoil movement of the chassis (e.g. movement of the chassis from the projectile being fired until the chassis is rendered stationary by the braking system) is at most 3 metres.

In some embodiments the recoil movement of the chassis (e.g. movement of the chassis from the projectile being fired until the chassis is rendered stationary by the braking system) is in the range of 0.5 to 3 metres.

According to the present disclosure, there is also provided a method of operating a mobile gun system, the mobile gun system comprising a chassis and a gun barrel, the method comprising: firing a projectile from the gun barrel such that a recoil force causes recoil movement of the chassis; and, operating a braking system to retard said recoil movement of the chassis after a peak loading condition due to the firing of the projectile has passed.

In some embodiments, a recoil mitigation force is exerted on the gun barrel to retard movement of the gun barrel relative to the chassis, and wherein the peak loading condition is when the recoil mitigation force reaches a peak value.

According to the present disclosure, there is also provided a mobile gun system comprising: a chassis; a gun barrel mounted to the chassis such that when a projectile is fired from the gun barrel a recoil force causes the gun barrel to move relative to the chassis; a recoil mitigation system configured to exert a recoil mitigation force on the gun barrel to retard said movement of the gun barrel relative to the chassis; a braking system for retarding the recoil movement of the chassis due to the recoil force from the firing of the projectile from the gun barrel; and, a controller configured to control the braking system to retard said recoil movement of the chassis after the recoil mitigation force exerted on the gun barrel by the recoil mitigation system in response to the firing of the projectile reaches a peak value.

BRIEF DESCRIPTION OF THE FIGURES

Embodiments of the invention will now be described by way of example only with reference to the figures, in which.

DETAILED DESCRIPTION

Figure 2:
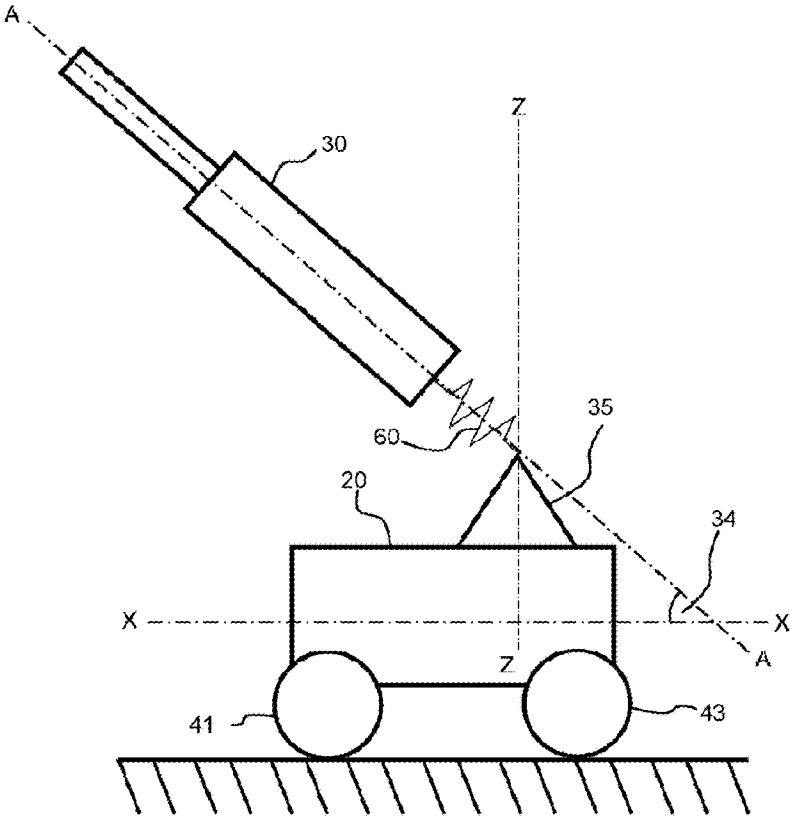
FIG. 2 is a schematic side view of the mobile gun system of FIG. 1, with a gun barrel in an elevated position.

Referring briefly to FIGS. 1 to 4, the present disclosure relates to a mobile gun system 10 comprising a chassis 20 and a gun barrel 30 mounted to the chassis 20 such that when a projectile is fired from the gun barrel 30 a recoil force Fr causes recoil movement of the chassis 20. The recoil movement of the chassis 20 may be the chassis 20 rolling due to the recoil force Fr. For example, if the projectile is fired from the barrel 30 in a forward direction, then the recoil force Fr causes the chassis 20 to roll rearwardly.

The mobile gun system 10 further comprises a braking system 70 for retarding the recoil movement of the chassis 20 due to the recoil force Fr from the firing of the projectile from the gun barrel 30.

The mobile gun system 10 further comprises a controller 80 configured to control the braking system 70 to retard said recoil movement of the chassis 20 after a peak loading condition due to the firing of the projectile has passed. Therefore, the chassis 20 is initially permitted to roll (e.g. rearwardly) due to the recoil force Fr until the peak loading condition has passed, and then the braking system 70 is operated by the controller 80 to retard further rolling of the chassis 20. Optionally, a minor braking force (e.g. from a parking brake) is applied whilst the projectile is fired in order to stabilize the mobile gun system 10. The minor braking force is insufficient to prevent the recoil movement of the mobile gun system 10 when the projectile is fired. The braking system 70 is then operated after the peak loading condition has passed in order to retard the recoil movement of the mobile gun system 10.

In some embodiments, the gun barrel 30 is mounted to the chassis 20 such that when a projectile is fired from the gun barrel 30 the recoil force Fr causes the gun barrel 30 to move relative to the chassis 20. The mobile gun system 10 further comprises a recoil mitigation system 60 configured to exert a recoil mitigation force Fm on the gun barrel 30 to retard said movement of the gun barrel 30 relative to the chassis 20. In various embodiments, the recoil mitigation system 60 does not fully dissipate the recoil momentum due to the firing of the projectile, such that the gun system 10 still rolls back after firing as described above. After the peak loading condition has passed, a braking force may be applied or increased so as to retard the recoil movement of the gun system 10, until it is brought to a halt. The peak loading condition may be when the recoil mitigation force Fm exerted on the gun barrel 30 by the recoil mitigation system 60 in response to the firing of the projectile reaches a peak value.

In some embodiments, the mobile gun system 10 comprises a sensor 90 connected to the controller 80, wherein the controller 80 is configured to determine whether the peak loading condition (e.g. peak recoil mitigation force Fm) has passed based on information detected by the sensor 90. In other embodiments, the sensor 90 is omitted and instead the controller 80 makes a determination that the peak loading condition (e.g. peak recoil mitigation force Fm) has passed by determining that a predetermined time period has passed since a command was given to fire the projectile, and then operates the braking system 70 to brake the mobile gun system 10.

In some embodiments, the controller 80 is configured to control the braking system 70 to retard said recoil movement of the chassis 20 after the projectile has exited the gun barrel 30. In some embodiments, the projectile leaving the barrel 30 is determined using a sensor (not shown). For example, the sensor may be a muzzle radar. The muzzle radar may be configured to determine that the projectile has exited the barrel 30. In another embodiment, the projectile exiting the barrel 30 may be determined based on the barrel 30 movement.

In some embodiments, the controller 80 is configured to control the braking system 70 to retard said recoil movement of the chassis 20 a predetermined time period after the projectile has exited the barrel 30. For example, once the controller 80 receives a signal from said sensor (e.g. a muzzle radar) that determines the projectile has exited the barrel, the controller then waits a predetermined time period before operating the braking system 70 to retard the recoil movement, the predetermined time being chosen such that after the predetermined time, the peak loading condition has passed.

In some embodiments, the recoil mitigation system 60 is omitted. In this case, peak loading may occur before the projectile exits the barrel 30. Thus, by determining that the projectile has exited the barrel, it can be determined that peak loading condition has passed.

An advantage of the controller 80 being configured to operate the braking system 70 to retard the recoil movement after the peak loading condition (for example, the peak recoil mitigation force Fm) has passed is that this reduces the stresses placed on the chassis 20 by the recoil. That is, the chassis 20 is able to move freely (or relatively freely if a parking brake or other minor braking force is applied whilst the projectile is fired) until the peak recoil has dissipated, at which point the braking system 70 is operated to retard the recoil movement of the chassis 20.

Another advantage of the controller 80 being configured to operate the braking system 70 to retard the recoil movement after the peak loading condition (for example, the peak recoil mitigation force Fm) has passed is that the stability of the mobile gun system 10 is improved. That is, if the braking system 70 was instead operated before the peak loading has passed then this would increase the likelihood of one or more of the wheels of the mobile gun system 10 lifting from the ground, and potentially the mobile gun system 10 overturning.

The peak loading condition may be when the peak force is exerted on the body of the mobile gun system 10 (e.g. on the chassis 20) due to the firing of the projectile from the gun barrel 30.

Referring again to FIGS. 1 to 8, the mobile gun system 10 will now be described in more detail.

As shown, the mobile gun system 10 comprises a chassis 20 and a gun barrel 30 mounted to the chassis 20. The mobile gun system 10 further comprises a plurality of wheels 41, 42, 43, 44 on which the chassis 20 is mounted. In the example of FIGS. 1 to 8, the mobile gun system 10 comprises four wheels 41, 42, 43, 44. However, it should be recognized that in other embodiments (not shown) the mobile gun system 10 may comprise a different number of wheels, and may alternatively or additionally comprise one or more tracks.

The wheels 41, 42, 43, 44 contact a support surface to allow for the mobile gun system 10 to move over the support surface. In the present example, the support surface is the ground G.

In the present example, the mobile gun system 10 is a self-propelled gun system 10, comprising a powertrain 50 that is configured to drive the plurality of wheels 41, 42, 43, 44 to propel the gun system 10. However, it should be recognized that in other embodiments the mobile gun system 10 may not be self-propelled and instead is towed by another vehicle to transport the gun system 10. In some embodiments, the mobile gun system 10 is a field gun. Self-propelled and towed gun systems 10 are both examples of mobile gun systems 10. The mobile gun system 10 may be a howitzer.

The powertrain 50 may comprise a power source 51 and a drive train 52 configured to deliver power from the power source 51 to the wheels 41, 42, 43, 44. The powertrain 50 is shown schematically in FIG. 5. The power source 51 may comprise, for example, an internal combustion engine, electric motor or a hybrid drive. The drive train 52 may include a gearbox and/or one or more shafts for driving the wheels 41, 42, 43, 44 to propel the mobile gun system 10.

Figure 1:
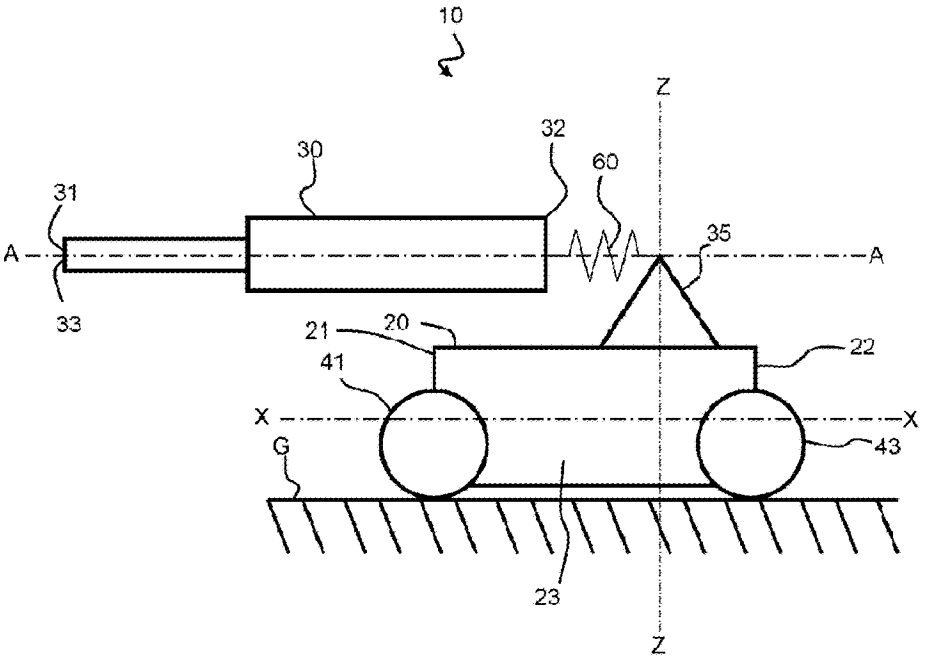
FIG. 1 is a schematic side view of a mobile gun system according to the present invention.
Figure 4:
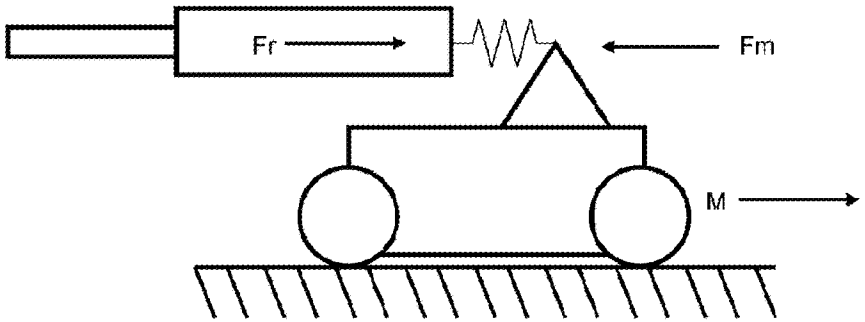
FIG. 4 is a schematic side view of the mobile gun system of FIG. 1.
Figure 3:
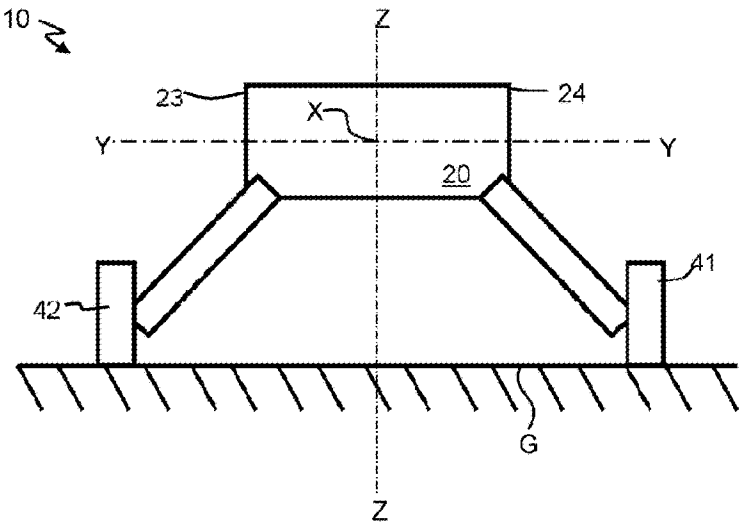
FIG. 3 is a schematic front view of the chassis and wheels of the mobile gun system of FIG. 1.
Figure 6:
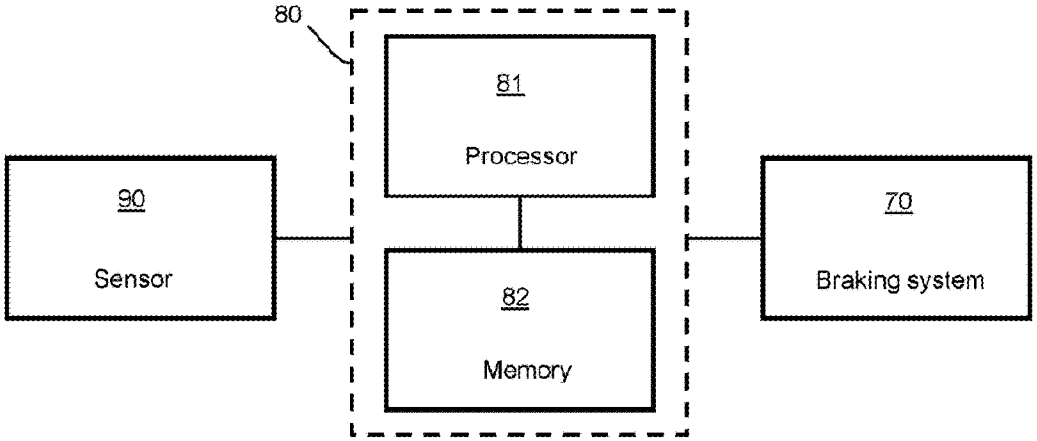
FIG. 6 is a schematic view of a controller of the mobile gun system of FIG. 1.
Figure 5:
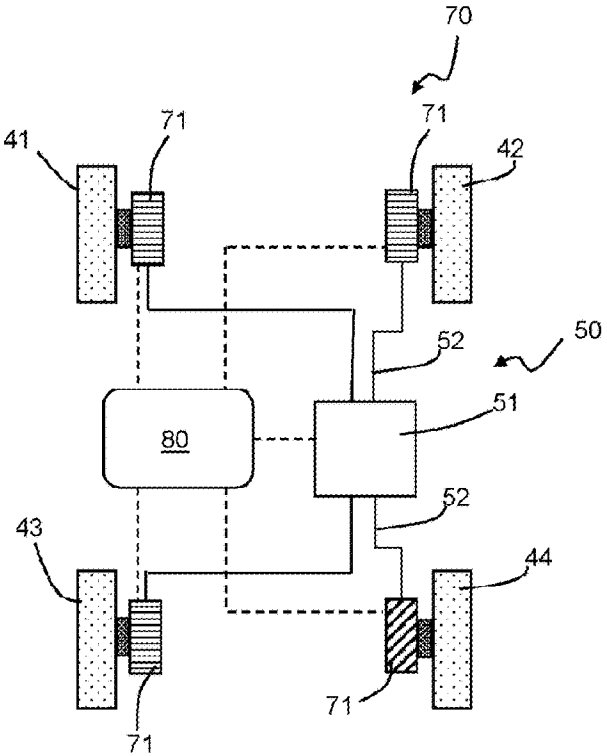
FIG. 5 is a schematic view of a powertrain of the mobile gun system of FIG. 1.

The chassis 20 extends along an x-axis (depicted by line 'X-X' in FIGS. 1 and 2). A first end 21 of the chassis 20 and a second end 22 of the chassis 20 are spaced apart from one another along the length of the chassis 20 along the x-axis. The chassis 20 also extends along a y-axis (shown by line 'Y-Y' in FIG. 3) along the width of the chassis 20. The x-axis is at right angles to the y-axis. A first side 23 of the chassis 20 and a second side 24 of the chassis 20 are spaced apart from one another across the width of the chassis 20 along the y-axis. The chassis 20 further comprises a z-axis (depicted by line 'Z-Z' in FIGS. 1 to 3) that is at right angles to the x-axis and y-axis. The z-axis may extend substantially normal to the ground.

The gun barrel 30 comprises a front end 31 and a rear end 32. A muzzle 33 provided towards the front end 31 and a breach assembly (not shown) is provided at the rear end 32. A projectile (not shown) can be loaded into the gun barrel 30 via the breach assembly and fired such that the projectile exits the front end 31 of the gun barrel 30.

The gun barrel 30 has a barrel axis (shown by line 'A-A' in FIGS. 1 and 2) that extends longitudinally along the centre of the bore of the gun barrel 30. The gun barrel 30 is mounted to the chassis 20 by a pivot mount 35. The barrel 30 is pivotable relative to the x-axis about a pivot axis aligned and/or parallel with the y-axis. Therefore, the elevation of the front end 31 can be adjusted by pivoting the barrel 30 about the pivot mount 35. This pivoting motion of the gun barrel 30 adjusts an angle 34 between the barrel axis and the x-axis.

In some examples, the gun barrel 30 is constrained to pivot about the pivot axis in a plane of movement extending through the x-axis and z-axis and/or is constrained to pivot about the pivot axis between −5 degrees to the x-axis and +75 degrees to the x-axis.

The gun barrel 30 may be constrained to be rotatable by no more than +/−5 degrees relative to a direction parallel to the x-axis around the z-axis.

In some embodiments, the mobile gun system 10 may not be capable of firing broadside. The range of motion of the gun barrel 30 relative to the chassis 20 may be limited such that the gun barrel 30 is not capable of being rotated relative to the chassis 20 to a position to fire broadside.

When the projectile is fired from the gun barrel 30, a recoil force (shown by arrow 'Fr' in FIG. 4) is exerted on the gun barrel 30 that urges the gun barrel 30 in an opposite direction to the direction of motion of the projectile.

In the present example, the gun barrel 30 is mounted to the chassis 20 such that when the projectile is fired from the gun barrel 30 the recoil force Fr causes the gun barrel 30 to move relative to the chassis 20. The gun barrel 30 may be mounted to the chassis 20 such that the gun barrel 30 slides relative to the chassis 20 in a direction along the barrel axis A-A.

The mobile gun system 10 comprises a recoil mitigation system 60 configured to exert a recoil mitigation force (shown by arrow 'Fm' in FIG. 4) on the gun barrel 30 to retard said movement of the gun barrel 30 relative to the chassis 20. The recoil mitigation force Fm is exerted on the gun barrel 30 in response to the recoil force Fr.

It should be recognized that in other embodiments the recoil mitigation system 60 is omitted and instead the gun barrel 30 may be mounted to the chassis 20 such that there is substantially no sliding movement of the gun barrel 30 relative to the chassis 20 when the projectile is fired.

Figure 7:
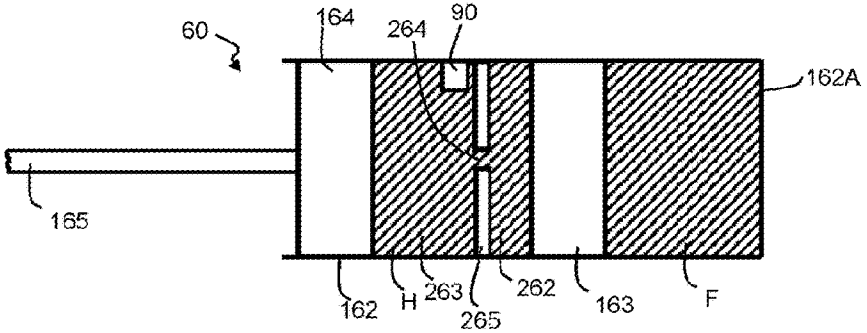
FIG. 7 is a schematic side view of a recoil mitigation system of the mobile gun system of FIG. 1, the recoil mitigation system comprising a damping mechanism.

The recoil mitigation system 60 is represented schematically in FIGS. 1 to 4. FIG. 7 is a schematic drawing of the recoil mitigation system 60, showing more detail than FIGS. 1 to 4.

The recoil mitigation system 60 comprises a recuperator configured to return the gun barrel 30 to its original position after the projectile has been fired and a damper configured to damp the movement of the gun barrel 30 relative to the chassis 20 when the projectile is fired.

The recuperator of the recoil mitigation system 60 comprises a compressible fluid F that is compressed under the recoil force Fr when the projectile is fired from the gun barrel 30. The damper of the recoil mitigation system 60 comprises a hydraulic fluid H and a passage 264 through which the hydraulic fluid H is urged, in order to convert kinetic energy of the gun barrel 30 into heat thereby damping motion of the gun barrel 30.

As shown in FIG. 7, the recoil mitigation system 60 comprises a cylinder 162 and first and second pistons 163, 164. The cylinder 162 contains the compressible fluid F, which is disposed at a first end 162A of the cylinder 162 on a first side of the first piston 163. The hydraulic fluid H is disposed on an opposite second side of the first piston 163. The second piston 164 is located within the cylinder 162, distal to the first end 162A of the cylinder 162, such that the hydraulic fluid H is disposed between the first and second pistons 163, 164. The first and second pistons 163, 164, are slidably received in the cylinder 162.

In some examples, the hydraulic fluid H is a liquid and, for example, may comprise oil. The hydraulic fluid H may be incompressible or substantially incompressible. In some examples, the compressible fluid F is a gas.

The cylinder 162 comprises first and second chambers 262, 263 that are separated by the restricted flow passage 264. The passage 264 allows for a restricted flow of the hydraulic fluid H between the first and second chambers 262, 263. The first piston 163 is located in the first chamber 262 and the second piston 164 is located in the second chamber 264.

Figure 8:
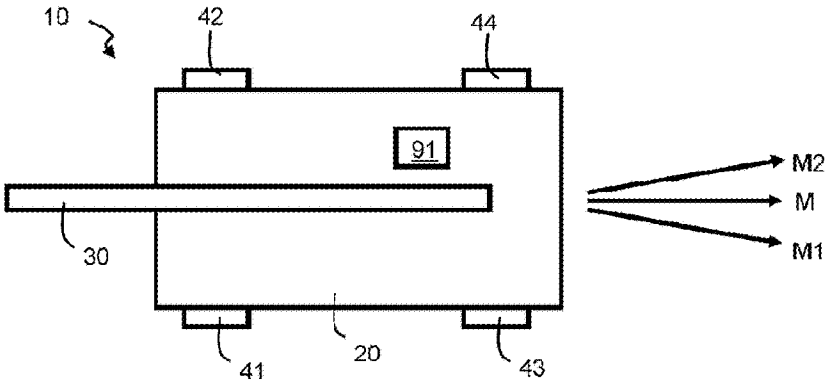
FIG. 8 is a schematic top view of the mobile gun system of FIG. 1.

The second piston 164 is coupled to the gun barrel 30, either directly or via one or more intermediate components. In the example of FIG. 8, the second piston 164 is coupled to the gun barrel 30 by a connecting rod 165. The cylinder 162 may be mounted to the chassis 20.

Movement of the gun barrel 30 relative to the chassis 20 when the projectile is fired causes the second piston 164 to be urged in to the second chamber 263 of the cylinder 162, towards the first end 162A of the cylinder 162, to urge the hydraulic fluid H through the restricted flow passage 264 and into the first chamber 262. This causes the hydraulic fluid H in the first chamber 262 to exert a force on the first piston 163 that urges the first piston 163 towards the first end 162A of the cylinder 162 to compress the compressible fluid F. Therefore, the compression of the compressible fluid F acts to store energy. The compressible fluid F subsequently re-expands in order to return the gun barrel 30 to the original position (i.e. the position of the gun barrel 30 prior to the firing of the projectile from the barrel 30). That is, the recoil mitigation system 60 acts as a pneumatic recuperator, with the compressible fluid F returning the barrel 30 to its original position.

In the present example, the restricted flow passage 264 comprises one or more orifices in a plate 265 disposed between the first and second chambers 262, 263. In other embodiments, the restricted flow passage 264 may comprise a narrowing in the internal cross-section of the cylinder 162, or the second piston 164 may comprise one or more orifices through which the hydraulic fluid H flows.

The restricted flow passage 264 between the first and second chambers 262, 263 introduces turbulence to the flow of the hydraulic fluid H between the first and second chambers 262, 263. Therefore, kinetic energy of the gun barrel 30 due to recoil is converted into heat, thereby damping the motion of the gun barrel 30.

The recoil mitigation system 60 increases the time over which the initial impulse of the recoil force Fr is dissipated, thereby reducing the peak force exerted on the chassis 20 of the mobile gun system 10.

As explained above, the compressible fluid F is compressed as the gun barrel 30 recoils when the projectile is fired. The compressible fluid F then re-expands to urge the gun barrel 30 to return to its original position. That is, the recoil mitigation system 60 acts as a recuperator. In the present example, the recuperator and damper are incorporated into the same device (and into the same cylinder 162). In other embodiments (not shown), the recoil mitigation system may alternatively, or additionally, comprise a first mechanism for returning the gun barrel 30 to its original position after the firing of a projectile and a second mechanism for damping motion of the gun barrel 30.

In the present example, the recoil mitigation system 60 comprises a pneumatic recuperator and a hydraulic damping mechanism. However, it should be recognized that in other embodiments (not shown), the recoil mitigation system 60 may comprise a mechanical recuperator. In some embodiments (not shown), the recoil mitigation system 60 comprises a biasing member (e.g a spring) coupled to the chassis 20 and gun barrel 30 such that when the gun barrel 30 moves relative to the chassis 20 due to the recoil force Fr, the biasing member is resiliently deformed. The resilient deformation of the biasing member may be compression of the biasing member. Re-expansion of the biasing member after the gun barrel has recoiled relative to the chassis 20 urges the gun barrel 30 to return to its original position.

In the embodiment of FIGS. 1 to 8, the damper is a hydraulic damping mechanism. However, it should be recognized that in other embodiments the damper may be, for example, a pneumatic or magnetic damper.

The mobile gun system 10 further comprises a braking system 70 for retarding recoil movement of the chassis 20 due to the recoil force Fr from the firing of the projectile from the gun barrel 30.

The braking system 70 comprises one or more braking devices 71 that are each operable to brake a wheel or track of the mobile gun system 10. In the present example, the braking system 70 comprise four braking devices 71 that are each configured to brake a respective wheel 41, 42, 43, 44 of the mobile gun system 10. However, in other embodiments (not shown) the braking system 70 is configured to brake only some of the wheels 41, 42, 43, 44, for example, only the first and second wheels 41, 42 of the mobile gun system 10. In one embodiment (not shown), the mobile gun system 70 is configured to only brake one wheel or track of the mobile gun system 70, for example, a wheel or track that is mounted centrally with respect to the chassis 20, between the first and second sides 23, 24 of the chassis 20.

The braking devices 71 are each friction braking devices 71 configured to brake the wheels 41, 42, 43, 44 by increasing friction between a component mounted to the respective wheels 41, 42, 43, 44 and a component mounted to the chassis 20 of the mobile gun system 10. For example, each braking device 71 may comprise a brake rotor or drum coupled to a respective wheel 41, 42, 43, 44 and a brake pad or shoe that can be moved into contact with the brake rotor or drum to frictionally brake the mobile gun system 10. However, it should be recognized that the braking system 70 may be of a different configuration and does not necessarily frictionally brake the wheels 41, 42, 43, 44.

The or each braking device 71 may be actuated hydraulically, electrically, magnetically and/or pneumatically to control braking of the mobile gun system 10.

The mobile gun system 10 further comprises a controller 80 configured to control the braking system 70 to retard said recoil movement of the chassis 20 after a peak loading condition due to the firing of the projectile has passed.

In the present example, the peak loading condition is when the recoil mitigation force Fm exerted on the gun barrel 30 by the recoil mitigation system 60 in response to the firing of the projectile reaches a peak value. Thus, when the peak recoil mitigation force Fm exerted on the gun barrel 30 by the recoil mitigation system 60 has passed, the peak loading on the body of the mobile gun system 10 will also have passed.

In the present example, the controller 80 comprises a processor 81 and a memory 82. The memory 82 is configured to store instructions and the processor 81 is configured to carry out instructions stored in the memory 82.

The mobile gun system 10 comprises a sensor 90 that is connected to the controller 80. The sensor 90 is configured to detect information indicative of the recoil mitigation force Fm. The sensor 90 may be configured to detect a loading condition of the recoil mitigation system 60. The controller 80 may be configured to receive a signal from the sensor 90.

In the example shown in FIGS. 1 to 8, the sensor 90 is configured to detect information indicative of a parameter of the hydraulic fluid H. For example, the parameter of the hydraulic fluid H may be the pressure of the hydraulic fluid H. For example, the sensor 90 may be a pressure sensor that is located in the first or second chamber 262, 263.

As the gun barrel 30 moves relative to the chassis 20 due to the recoil force Fr, the pressure of the hydraulic fluid H in the cylinder 162 increases as the second piston 163 moves towards the end 162A of the cylinder 162. In reaction to the recoil force Fr, the recoil mitigation force Fm is exerted on the second piston 164 to retard the motion of the second piston 164 towards the first end 162A of the cylinder 162 and thus retard the motion of the gun barrel 30 that is coupled to the second piston 164. The recoil mitigation force Fm increases as the second piston 164 moves towards the first end 162A of the cylinder 162 due to recoil movement of the barrel 30, and will reach a peak value (in the present example, the peak value of the recoil mitigation force Fm coincides with when the pressure of the hydraulic fluid H reaches a peak value), and then the recoil mitigation force Fm will reduce.

Detecting the pressure of the hydraulic fluid H using the sensor 90 therefore allows for the controller 80 to determine when the recoil mitigation force Fm exerted on the gun barrel 30 by the recoil mitigation system 60 in reaction to the recoil force Fr reaches a peak value. When the controller 80 receives information from the sensor 90 indicative that the peak pressure of the compressible fluid F has passed, the controller 80 can determine that the peak recoil mitigation force Fm has also passed. Therefore, the controller 80 can operate the braking system 70 to retard motion of the mobile gun system 10, as will be explained below.

The sensor 90 may be a pressure sensor that, for example, is mounted to the cylinder 162 or first or second piston 163, 164 to detect the pressure of the compressible fluid F in the cylinder 162.

In another embodiment (not shown), the sensor 90 is a force sensor that is configured to measure the force exerted on the body of the mobile gun system 10, for example, the force exerted on the chassis 20 of the mobile gun system 10 or a component mounted to or coupled to the chassis 20. For example, the sensor 90 may be connected between the damper (e.g. a component of the damping mechanism) and the chassis 20 to detect the force exerted on the chassis 20 by the damper when the projectile is fired. When the force measured by the force sensor 90 reaches a peak value, the peak loading condition has reached a peak value, and therefore the controller 80 can use the information detected by the force sensor 90 to determine when to operate the braking system 70. In one such embodiment (not shown), the force sensor 90 is connected between the cylinder 162 and the body of the mobile gun system 10, for example, between the cylinder 162 and the chassis 20, to detect the force exerted on the body by the cylinder 162 when the projectile is fired.

In another embodiment, the sensor 90 is configured to measure the motion of the gun barrel 30. In one embodiment, the sensor 90 is configured to measure one or more of: the velocity and/or acceleration of the gun barrel 30 as the gun barrel 30 moves after the firing of the projectile. In some embodiments, the velocity and/or acceleration of the gun barrel 30 is measured relative to the chassis 20. The controller 80 may be configured to determine that the peak loading condition has passed based on the measured velocity and/or acceleration of the gun barrel 30.

In another embodiment, the damper is a magnetic damper and the sensor 90 is configured to measure one or more of a voltage and/or current generated by the magnetic damper (or a sensor coupled to the magnetic damper) as the gun barrel 30 moves relative to the chassis 20.

It should be recognized that in other embodiments, the sensor 90 is omitted and instead the controller 80 makes a determination that the peak loading condition (e.g. peak recoil mitigation force Fm) has occurred by determining that a predetermined time period has passed since a command was given to fire the projectile, and then operating the braking system 70 to brake the mobile gun system 10.

In some embodiments, the controller 80 is configured to control the braking system 70 to retard said recoil movement of the chassis 20 after the projectile has exited the gun barrel 30. In some embodiments, the projectile leaving the barrel 30 is determined using a sensor (not shown). For example, the sensor may be a muzzle radar. The muzzle radar may be configured to determine that the projectile has exited the barrel 30. In another embodiment, the projectile exiting the barrel 30 may be determined based on the barrel 30 movement.

In some embodiments, the controller 80 is configured to control the braking system 70 to retard said recoil movement of the chassis 20 a predetermined time period after the projectile has exited the barrel 30. For example, once the controller 80 receives a signal from said sensor that determines the projectile has exited the barrel (e.g. a muzzle radar), the controller then waits a predetermined time period before operating the braking system 70 to retard the recoil movement.

Operation of the mobile gun system 10 will now be described. A projectile is fired from the gun barrel 30, which causes a recoil force Fr to be exerted on the gun barrel 30 that urges the gun barrel 30 in an opposite direction to the motion of the projectile. As explained above, the recoil force Fr causes the gun barrel 30 to move relative to the chassis 20, wherein the recoil mitigation system 60 exerts a reactive recoil mitigation force Fm on the gun barrel 30 to retard motion of the gun barrel 30 relative to the chassis 20.

When the projectile is fired, the braking system 70 initially applies no or only a minor braking force to the wheels 41, 42, 43, 44 of the mobile gun system 10. Therefore, when the projectile is fired and the recoil force Fr is generated, the recoil force Fr causes recoil movement (depicted by arrow 'M' in FIG. 4) of the chassis 20. That is, the projectile is fired in a first direction, and this causes the chassis 20 to move in a second direction that is generally opposite to the first direction. In the present example, the projectile is fired forwardly and this causes rearward movement of the chassis 20. The wheels/tracks of the mobile gun system 10 move in order to permit the recoil movement M of the chassis 20.

As explained above, the controller 80 determines when the peak recoil mitigation force Fm exerted on the gun barrel 30 by the recoil mitigation system 60 has passed. In some embodiments, the mobile gun system 10 comprises a sensor 90 configured to detect information indicative of the recoil mitigation force Fm, wherein the controller 80 operates the braking system 70 to retard the recoil movement of the chassis 20 when the controller 80 determines that the peak recoil mitigation force Fm has passed based on the information provided by the sensor 90.

In other embodiments, the controller 80 is configured to wait a predetermined time period after the projectile is fired, and then to operate the braking system 70 to retard the recoil movement of the chassis 20. The time period is a known period by which the peak recoil mitigation force Fm will have passed. The time period may be calculated and/or adjusted based on, for example, the size of the charge of the projectile and the length of the gun barrel 30.

When the controller 80 has determined that the peak recoil mitigation force Fm has passed, the controller 80 operates the braking system 70 such that the or each braking device 71 exerts a braking force (or an increased braking force) on the wheels 41, 42, 43, 44 of the mobile gun system 10 to retard the recoil movement of the chassis 20 until the chassis 20 is brought to a stop. Therefore, the braking system 70 reduces the distance of the recoil movement of the chassis 20 after the projectile is fired.

The mobile gun system 10 is thus operated such that a projectile is fired from the barrel 30, the barrel 30 moves relative to the chassis 20 and the chassis 20 moves rearwardly, and then the braking system 70 is operated to retard the rearward movement of the chassis 20.

The braking force may be applied (or increased) immediately after the peak recoil mitigation force Fm has passed, or it may be applied (or increased) when a predetermined period has passed after the recoil mitigation force Fm has passed. In some embodiments, the controller 80 operates the braking system 70 to begin to apply (or to begin to increase) the braking force after the peak recoil mitigation force Fm has passed, and then to vary the braking force in accordance with a predetermined braking profile, for example by continuously increasing the braking force until the gun system 10 comes to a halt.

In some embodiments, the braking system 70 comprises an anti-lock braking system (ABS). It has been found that this reduces the distance of the recoil movement and also prevents the wheels 41, 42, 43, 44 from skidding during braking of the mobile gun system 10.

An advantage of the controller 80 being configured to operate the braking system 70 to retard the recoil movement after the peak loading condition (for example, the peak recoil mitigation force Fm) has passed is that this reduces the stresses placed on the chassis 20 by the recoil. That is, the chassis 20 is able to move freely (or relatively freely if a handbrake or other minor braking force is applied whilst the projectile is fired) until the peak recoil has dissipated, at which point the braking system 70 is operated to retard the recoil movement of the chassis 20.

In some embodiments, the braking system 70 is configured to apply a minor braking force prior to the peak recoil mitigation force Fm, and wherein the braking system 70 applies a larger braking force after the peak recoil mitigation force Fm has passed. For example, before the projectile is fired, the braking system 70 may be configured to apply a minor braking force to the wheels 41, 42, 43, 44 to prevent rolling or unintentional movement of the chassis 20 whilst the mobile gun system 10 is parked. The minor braking force is insufficient to prevent the recoil movement of the chassis 20 when the projectile is fired from the gun barrel 30. When the peak recoil mitigation force Fm has passed, the controller 80 operates the braking system 70 to apply an increased braking force to retard the recoil movement of the chassis 20.

The minor braking force may be applied by one or more of the braking devices 71 that retard the recoil movement of the chassis 20, or the braking system 70 may comprise a further braking device (not shown) for applying the minor braking force, for example, a parking brake or handbrake.

In some embodiments, the minor braking force applied by the braking system 70 is constant or substantially constant. This has been found to improve the accuracy of the mobile gun system 10.

In some embodiments, the braking system 70 is configured to apply the minor braking force until the projectile has left the barrel 30, at which point the minor braking force is no longer applied and the chassis 20 moves unimpeded by any braking force of the braking system 70 until the peak recoil mitigation force Fm has passed, at which point the mobile braking system 70 is operated to retard the recoil movement of the chassis 20. In some embodiments, the projectile leaving the barrel 30 is determined using a sensor. For example, the sensor may be a muzzle radar. In another embodiment, the projectile exiting the barrel 30 may be determined based on the barrel movement.

In some embodiments, the recoil movement M of the chassis 20 from the projectile being fired to the chassis 20 being rendered stationary is at least 0.5 metres.

In some embodiments, the recoil movement M of the chassis 20 from the projectile being fired to the chassis 20 being rendered stationary is at most 3 metres.

In some embodiments, the recoil movement M of the chassis 20 from the projectile being fired to the chassis 20 being rendered stationary is in the range of 0.5 to 3 metres.

It has been found that the chassis 20 may not travel straight back along a linear path during the recoil movement M. For example, if the mobile gun system 10 is located on uneven or loose ground then one or more of the wheels 41, 42, 43, 44 may achieve less traction with the ground such that the mobile gun system 41, 42, 43, 44 begins to turn as it moves rearward during the recoil movement M. This means that the barrel 30 will become unaligned with the target and therefore the mobile gun system 10 may need to be repositioned before firing the next projectile.

To alleviate this, the controller 80 may be configured to adjust the amount of braking applied to one or more of the wheels 41, 42, 43, 44 to adjust the direction of recoil movement M of the chassis 20 due to the recoil force Fr. For example, if the first wheel 41 and/or third wheel 43 shown in FIG. 8 loses traction or is retarded by an obstacle, the chassis 10 may begin to turn in the direction of arrow 'M1'. To compensate for this, the braking force applied by the braking system 70 to the second and/or fourth wheel 42, 44 may be increased and/or the braking force applied by the braking system 70 to the first and/or third wheel 41, 43 may be decreased. Therefore, the orientation of the chassis 20 will be adjusted to move more closely along the intended path of recoil movement M. Similarly, if the second wheel 42 and/or fourth wheel 44 shown in FIG. 8 loses traction or is retarded by an obstacle, the chassis 10 may begin to turn in the direction of arrow 'M2'. To compensate for this, the braking force applied by the braking system 70 to the first and/or third wheel 41, 43 may be increased and/or the braking force applied by the braking system 70 to the second and/or fourth wheel 42, 44 may be decreased In some embodiments, the mobile gun system 10 comprises an orientation sensor 91 configured to detect information indicative of the orientation of the chassis 20. The controller 80 may be configured to adjust the direction of recoil movement M of the chassis 20 based on the information detected by the orientation sensor 91. The orientation sensor 91 may comprise, for example, a compass or accelerometer. The orientation sensor 91 may be an inertial navigation unit.

In some embodiments, the mobile gun system 10 is a deployable mobile gun system 10 and may be a helicopter deployable mobile gun system 10. Therefore, the gun system 10 can be lifted by helicopter and rapidly deployed.

Conventional army helicopters may have a lift capacity of around 10 tonnes. Therefore, in some embodiments, the unladen mass of the mobile gun system 10 is no greater than 10 tonnes and, preferably, is no greater than 5 tonnes.

In some embodiments, the mobile gun system 10 does not comprise any anchors and/or spades that are deployed to anchor the mobile gun system 10 relative to the ground prior to firing the projectile. Advantageously, this makes the mobile gun system 10 lighter and quicker to deploy, and instead the recoil is managed by the braking system 70.

In some embodiments, the gun barrel 30 has a calibre of at least 40 mm and, preferably, at least 60, 80, 100, 105, 120, 140 or 155 mm. In some embodiments, the gun barrel 30 has a calibre of at most 160 mm and, preferably, at most 155.

In some embodiments, the gun barrel 30 has a calibre in the range of 40 to 155 mm.

In some embodiments, the mobile gun system 10 is configured to be self-propelled to transport the mobile gun system 10 between different locations, and wherein the braking system 70 is configured to be operable to brake the mobile gun system 10 during said transportation. Advantageously, using the existing braking system of the mobile gun system 10 to also mitigate recoil saves cost and weight over systems wherein a separate braking device is provided to mitigate recoil.

Figure 9:
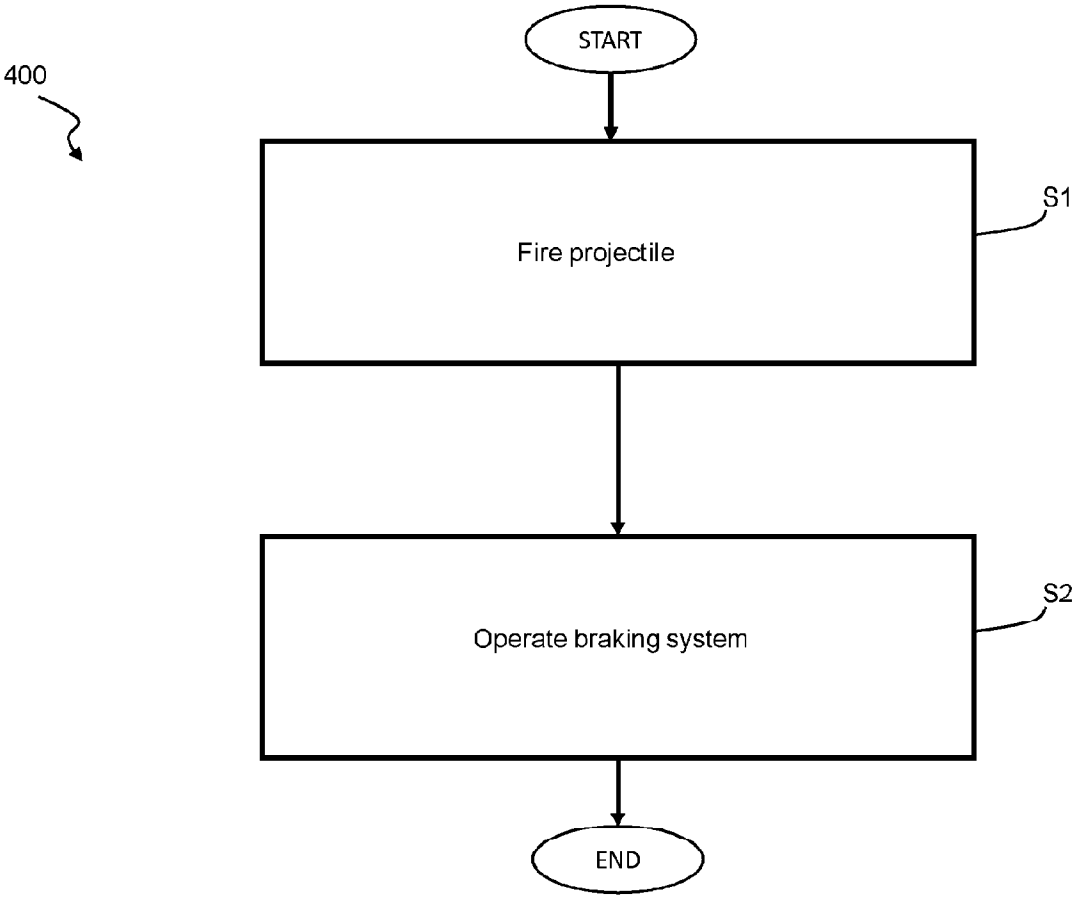
FIG. 9 is a block diagram showing an embodiment of a method of operating a mobile gun system.

Referring now to FIG. 9, one example of a method 400 of operating a mobile gun system 10 is shown. The mobile gun system 10 comprises a chassis 20 and a gun barrel 30.

The method 400 comprises firing a projectile from the gun barrel 30 such that a recoil force Fr causes recoil movement of the chassis 20 (step 'S1'). The method 400 further comprises operating a braking system 70 to retard said recoil movement of the chassis 20 after a peak loading condition due to the firing of the projectile has passed (step 'S2'). In some embodiments of the method 400, a recoil mitigation force is exerted on the gun barrel 30 to retard movement of the gun barrel 30 relative to the chassis 20, and wherein the peak loading condition is when the recoil mitigation force reaches a peak value.

In the above described embodiments, the controller 80 is configured to control the braking system 70 to retard the recoil movement of the chassis 20 after a peak loading condition has passed, wherein the peak loading condition is when the recoil mitigation force Fm exerted on the gun barrel 30 by the recoil mitigation system 60 in response to the firing of the projectile reaches a peak value. However, in other embodiments (not shown), the peak loading condition is the when the maximum load is placed on the chassis 20 due to the recoil force Fr and, optionally, the recoil mitigation system 60 may be omitted.

In one such embodiment (not shown), the gun barrel 30 is mounted to the chassis 20 such that the barrel 30 does not slide relative to the chassis 20 when the projectile is fired. The chassis 20 still has recoil movement M relative to the ground when the projectile is fired. The controller 80 is configured to control the braking system to retard the recoil movement of the chassis 20 after a peak loading condition due to the firing of the projectile has passed. For example, a sensor may measure information indicative of the force exerted on the chassis 20 when the projectile is fired, and the controller 80 uses the information detected by the sensor to determine when the peak loading has passed. The sensor could be, for example, a force sensor or an accelerometer. In another embodiment, the controller 80 determines that the peak loading has passed by determining that the projectile has exited the barrel 30 (i.e. even if the peak loading occurs prior to the projectile exiting the barrel 30, as can occur if the recoil mitigation system 60 is omitted). For instance, a muzzle radar (not shown) may be connected to the controller 80 so that the controller 80 can determine that the projectile has exited the barrel 30.

Figure 11:
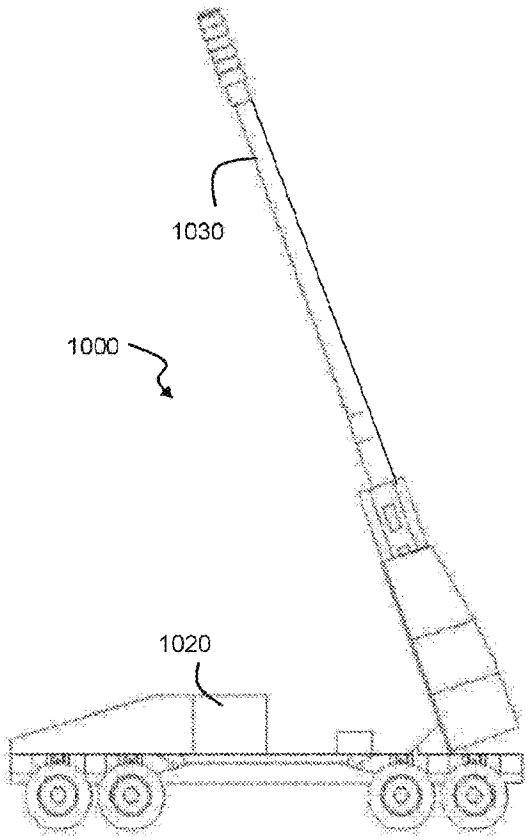
Figure 10:
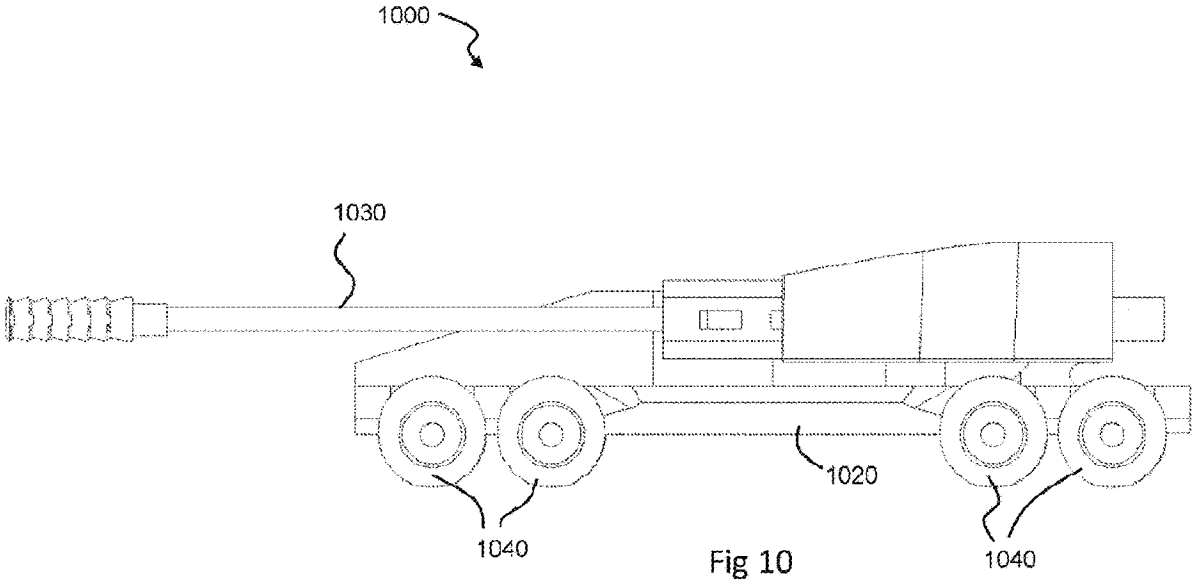
FIG. 10 is a schematic side view of another embodiment of a mobile gun system according to the present invention; and, FIG. 11 is a schematic side view of the mobile gun system of FIG. 10, with a gun barrel in an elevated position.

Referring to FIGS. 10 and 11, an alternative embodiment of a mobile gun system 1000 is shown. The mobile gun system 1000 includes a body comprising a chassis 1020, and a gun barrel 1030 mounted to the body such that when a projectile is fired from the gun barrel 1030 a recoil force causes recoil movement of the chassis 1020. The chassis 1020 is mounted to a plurality of wheels 1040.

The mobile gun system 1000 further comprises a braking system (not shown) for retarding the recoil movement of the chassis 1020 due to the recoil force from the firing of the projectile from the gun barrel 1030.

The mobile gun system 1000 further comprises a controller (not shown) configured to control the braking system to retard said recoil movement of the chassis 1020 after a peak loading condition due to the firing of the projectile has passed.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A mobile gun system comprising:

a chassis;

a gun barrel mounted to the chassis such that when a projectile is fired from the gun barrel a recoil force causes recoil movement of the chassis;

a braking system for retarding the recoil movement of the chassis due to the recoil force from the firing of the projectile from the gun barrel; and a controller configured to control the braking system to retard said recoil movement of the chassis after a peak loading condition due to the firing of the projectile has passed, wherein the braking system is configured to apply a reduced braking force prior to the peak loading condition, and wherein the braking system applies a larger braking force after the peak loading condition.

2. The mobile gun system according to claim 1, wherein the gun barrel is mounted to the chassis such that when a projectile is fired from the gun barrel the recoil force causes the gun barrel to move relative to the chassis, the mobile gun system further comprising a recoil mitigation system configured to exert a recoil mitigation force on the gun barrel to retard said movement of the gun barrel relative to the chassis.

3. The mobile gun system according to claim 2, wherein the peak loading condition is when the recoil mitigation force exerted on the gun barrel by the recoil mitigation system in response to the firing of the projectile reaches a peak value.

4. The mobile gun system according to claim 3, comprising a sensor connected to the controller, wherein the controller is configured to determine whether the peak loading condition has passed based on information detected by the sensor.

5. The mobile gun system according to claim 4, wherein the sensor is configured to detect information indicative of the recoil mitigation force.

6. The mobile gun system according to claim 5, wherein the recoil mitigation system comprises a fluid configured such that a pressure of the fluid increases when the gun barrel moves relative to the chassis due to the recoil force, and wherein the sensor is configured to detect information indicative of a parameter of the fluid.

7. The mobile gun system according to claim 6, wherein said parameter is a pressure of the fluid.

8. The mobile gun system according to claim 1, wherein the braking system comprises an anti-lock braking system (ABS).

9. The mobile gun system according to claim 1, comprising a plurality of wheels and/or tracks, and wherein the braking system is configured to brake at least one of the wheels and/or tracks to retard said recoil movement of the chassis.

10. The mobile gun system according to claim 9, wherein the controller is configured to adjust the amount of braking applied to one or more of the wheels and/or tracks to adjust the direction of recoil movement of the chassis due to the recoil force.

11. The mobile gun system according to claim 10, comprising an orientation sensor configured to detect information indicative of the orientation of the chassis, wherein the controller is configured to adjust the direction of recoil movement of the chassis based on the information detected by the orientation sensor.

12. The mobile gun system according to claim 1, wherein an unladen mass of the mobile gun system is no greater than 10 tonnes.

13. The mobile gun system according to claim 1, comprising a sensor connected to the controller, wherein the controller is configured to determine whether the peak loading condition has passed based on information detected by the sensor.

14. The mobile gun system according to claim 1, wherein an unladen mass of the mobile gun system is no greater than 5 tonnes.

15. A method of operating a mobile gun system, the mobile gun system comprising a chassis and a gun barrel, the method comprising:

firing a projectile from the gun barrel such that a recoil force causes recoil movement of the chassis; and operating a braking system to retard said recoil movement of the chassis after a peak loading condition due to the firing of the projectile has passed, wherein the braking system is configured to apply a reduced braking force prior to the peak loading condition, and wherein the braking system applies a larger braking force after the peak loading condition.

16. The method according to claim 15, wherein a recoil mitigation force is exerted on the gun barrel to retard movement of the gun barrel relative to the chassis, and wherein the peak loading condition is when the recoil mitigation force reaches a peak value.

17. A mobile gun system comprising:

a chassis;

a gun barrel mounted to the chassis such that when a projectile is fired from the gun barrel a recoil force causes the gun barrel to move relative to the chassis;

a recoil mitigation system configured to exert a recoil mitigation force on the gun barrel to retard said movement of the gun barrel relative to the chassis;

a braking system for retarding recoil movement of the chassis due to the recoil force from the firing of the projectile from the gun barrel;

a controller configured to control the braking system to retard said recoil movement of the chassis after a peak loading condition due to the firing of the projectile has passed, wherein the peak loading condition is when the recoil mitigation force exerted on the gun barrel by the recoil mitigation system in response to the firing of the projectile reaches a peak value; and a sensor connected to the controller, wherein the controller is configured to determine whether the peak loading condition has passed based on information detected by the sensor.

18. The mobile gun system according to claim 17, wherein the braking system is configured to apply a reduced braking force prior to the peak loading condition, and wherein the braking system applies a larger braking force after the peak loading condition.

* * * * *